United States Patent [19]

Haahjem

[11] Patent Number: 4,784,560

[45] Date of Patent: Nov. 15, 1988

[54] APPARATUS FOR TRIMMING AND EMPTYING BULK MATERIAL

[76] Inventor: Kaare Haahjem, N-6040 Vigra, Norway

[21] Appl. No.: 35,279

[22] Filed: Apr. 3, 1987

Related U.S. Application Data

[63] Continuation of Ser. No. 877,705, Jun. 20, 1986, abandoned, which is a continuation of Ser. No. 562,691, Dec. 19, 1983, abandoned.

[51] Int. Cl.[4] ..... B65G 67/60

[52] U.S. Cl. ..... 414/142.5; 198/516; 198/519

[58] Field of Search ..... 198/511, 516, 519; 414/144, 145

[56] References Cited

U.S. PATENT DOCUMENTS

| | | | |
|---|---|---|---|
| 1,058,306 | 4/1913 | Kindl | 414/139 |
| 1,584,442 | 5/1926 | Every | 414/145 |
| 3,144,142 | 8/1964 | Wallace, Jr. | 414/145 |
| 3,497,054 | 2/1970 | Van Kleunen | 198/519 X |
| 3,857,499 | 12/1974 | Harbolt et al. | 414/144 |
| 4,230,220 | 10/1980 | Iino | 414/144 |
| 4,286,909 | 9/1981 | Tingskog | 414/145 X |
| 4,350,467 | 9/1982 | Soros | 414/144 |
| 4,474,523 | 10/1984 | Ihle | 414/145 X |

FOREIGN PATENT DOCUMENTS 0055879 7/1982 .

*Primary Examiner*—Robert J. Spar
*Assistant Examiner*—Janice Krizek
*Attorney, Agent, or Firm*—Darby & Darby

[57] ABSTRACT

An apparatus for trimming and emptying bulk material in a cargo room (2) comprises two rake devices (18, 19) which at one end are connected to the lower end of a cargo lifter in the form of a vertical conveyor (16). The cargo lifter is suspended in a housing (9) which is movable transversely of the longitudinal direction of the ship on a chassis (8), which in turn is drivable on rails (4) along the top of the hatch coamings (22) of the ship. The cargo lifter feeds a transverse conveyor (12) on the chassis (8), which conveyor in turn feeds a conveyor (5) running in the longitudinal direction of the ship. The rakes (18, 19) are pivotable in the vertical plane and may be pivoted about a vertical axis, preferably together with the cargo lifter (16). When moving the apparatus from one cargo room to another or to parking position, the cargo lifter and the rakes are raised up into a telescoping extension (14) of the housing (9).

1 Claim, 7 Drawing Sheets

APPARATUS FOR TRIMMING AND EMPTYING BULK MATERIAL

This is a continuation of application Ser. No. 877,705 filed June 20, 1986 now abandoned, which is a continuation of application Ser. No. 562,691 filed Dec. 19, 1983 also abandoned.

The present invention relates to an apparatus for trimming and emptying bulk material from a storage room or hold, comprising at least one rake means which is movable vertically and transversely of the direction of motion of the bulk material, and which is arranged to move a bulk material towards a lifting means.

Such an apparatus is known from U.S. Pat. No. 4,170,433. Here, each hold has a fixed vertical transporter or lifting means which is fed with bulk material by two orthogonally arranged rake means. Since each hold must have fixed equipment, this system entails large expenditures for ships having a plurality of holds.

From U.S. Pat. No. 4,350,467 a system of a somewhat different character is known. Here, one has a lifting means arranged in the forward part of a ship. This lifting means is fed by a belt conveyor which extends centrally near the bottom of all the holds. In order to move that part of the bulk material which will not slide by itself down towards the belt conveyor, one uses two rake means which may be raised and lowered in the hold and, furthermore, are pivotable about one end. These rakes may be moved from one hold to another by means of a carriage which can be driven in the longitudinal direction of the ship on the top side of the holds. In this case the rakes must be sufficiently long to reach the sides of the hold in order to completely empty the hold. For the same reason the hatchways of the holds must extend almost the entire length of the holds in order not to leave material by the transverse bulkheads separating the holds. However, the longitudinal conveyor at the bottom of the ship necessitates an open connection between all holds. This entails that such a system may not be used for oceangoing vessels, because for such vessels it is required that the holds be separated by means of watertight bulkheads The purpose of the present invention is to provide a trimming and emptying apparatus for bulk material in a hold or storage chamber which does not suffer from the above drawbacks and deficiencies. This is obtained according to the invention by means of a trimming and emptying apparatus of the type mentioned in the first paragraph, the apparatus being characterized in that the lifting means is supported in a housing for raising and lowering, said housing being arranged on a chassis which is movable on the top side of said room, and in that said at least one rake means at one of its ends is pivotably attached near the lower end of the lifting means.

Thus one obtains an apparatus which may be moved from one room to another, so that in case the ship has several cargo rooms, only one apparatus is necessary. Since no part of the unloading system remains permanently in any of the holds, these may be separated by means of watertight bulkheads so that the ship will fulfill the requirements for oceangoing vessels.

According to an advantageous feature of the invention, the housing is movable on the chassis generally transversely of the direction of motion of the chassis. The lifting means and the rakes are of course also movable together with the housing so that the rakes can be brought into less accessible parts of the holds, i.a. between webs and other reinforcements. The transverse movablility of the rakes also entails that these may be made substantially shorter than half of the width of the room without sacificing the abiluty of the system to completely empty the hold.

According to another advantageous feature of the invention, the chassis carries a conveyor for transporting bulk material from the lifting means to a belt conveyor running along the track of the chassis. Thus, unloading may be performed irrespective of the position of the chassis and the position of the housing on the chassis.

The housing may advantageously be provided with a vertically telescoping extension wherein the lifting means is suspended. Thus, the housing will not extend higher than necessary whether the apparatus is in use or in parked condition. In this way it is easier to avoid the housing blocking the view from the bridge and avoid unnecessary stress and strain on the apparatus during transit in rough sea.

Furthermore, it is expedient to provide the apparatus with two rake means arranged on opposite sides of the lifting means. The reaction forces from thr rakes on their support thus will generally cancel each other and thereby minimize the stress and strain on the lifting means.

According to the invention it is also suggested that the supporting means for the rakes be made pivotable about a vertical axis, possibly together with the lifting means. Thus, the rakes may reach all parts of the cargo room even though the hatchway of the latter does not extend in its entire length.

The invention also comprises a ship having one or more cargo rooms which in the top is provided with at least one hatchway surrounded by a coaming, wherein thw ship also comprises a trimming and emptying apparatus according to the invention as previously stated. The coaming may be provided with rails on the outside on which the chassis of the apparatus may run, and the ship may also advantageously be provided with a parking space for the apparatus. This parking space may advantageously comprise a recess into which parts of the apparatus may be lowered when it is not in use. Thereby, the apparatus may be secured more easily when it is not in use, it will be less subjected to inertia forces when the ship moves in heavy sea, and it will be less likely to block the view from the bridge of the ship.

For the better understanding of the invention it will be described more closely with reference to the exemplifigying embodiment shown in the appended drawings.

Figure 1:
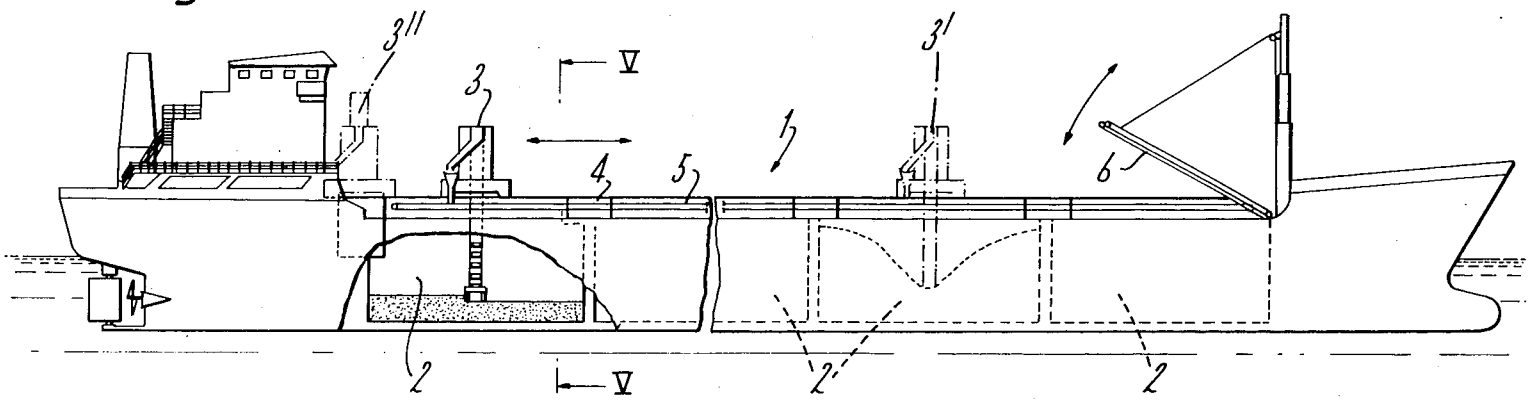
FIG. 1 shows a side view, partly in section, of a ship provided with an apparatus according to the invention.
Figure 5:
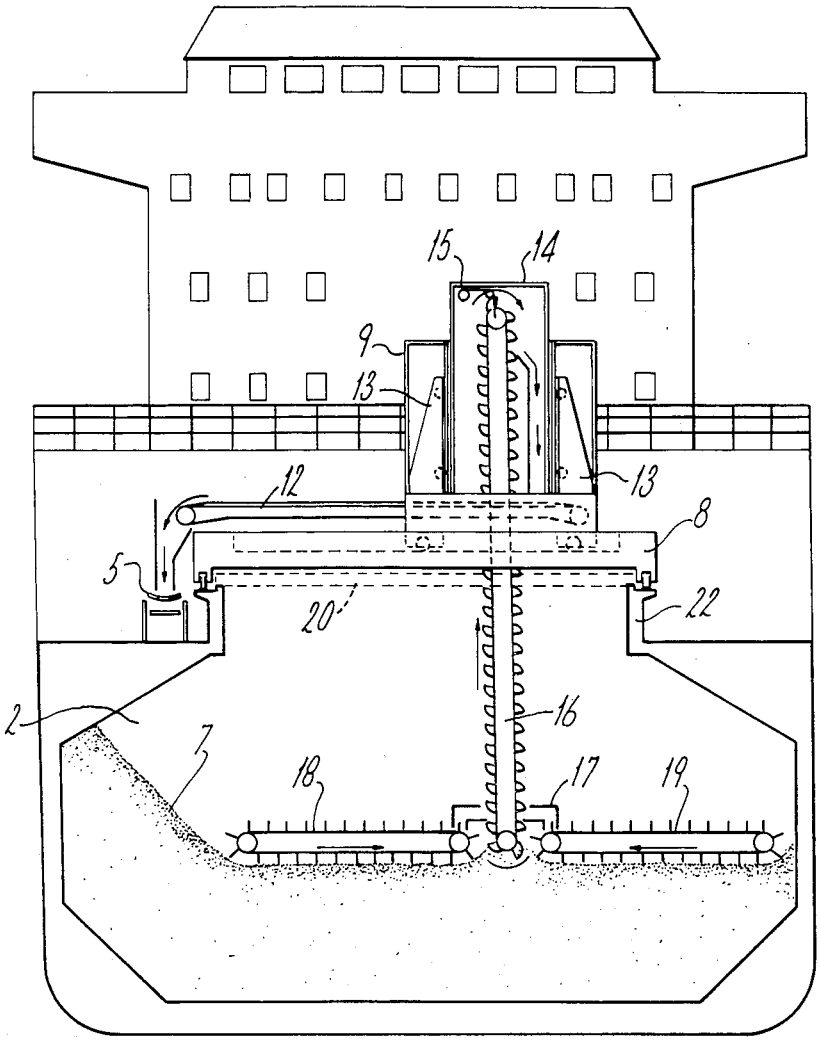

FIG. 5 generally shows a section along the line V—V in FIG. 1 at a larger scale.

Figure 6:
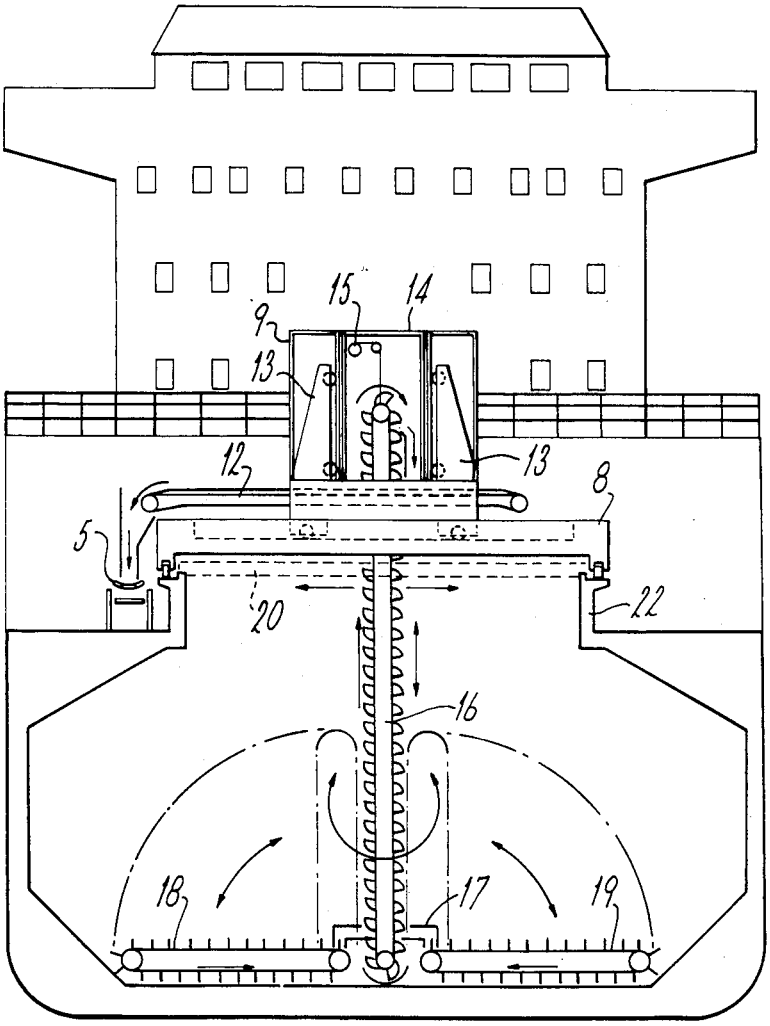

FIG. 6 shows a section like FIG. 5, but with an empty cargo room.

Figure 7:
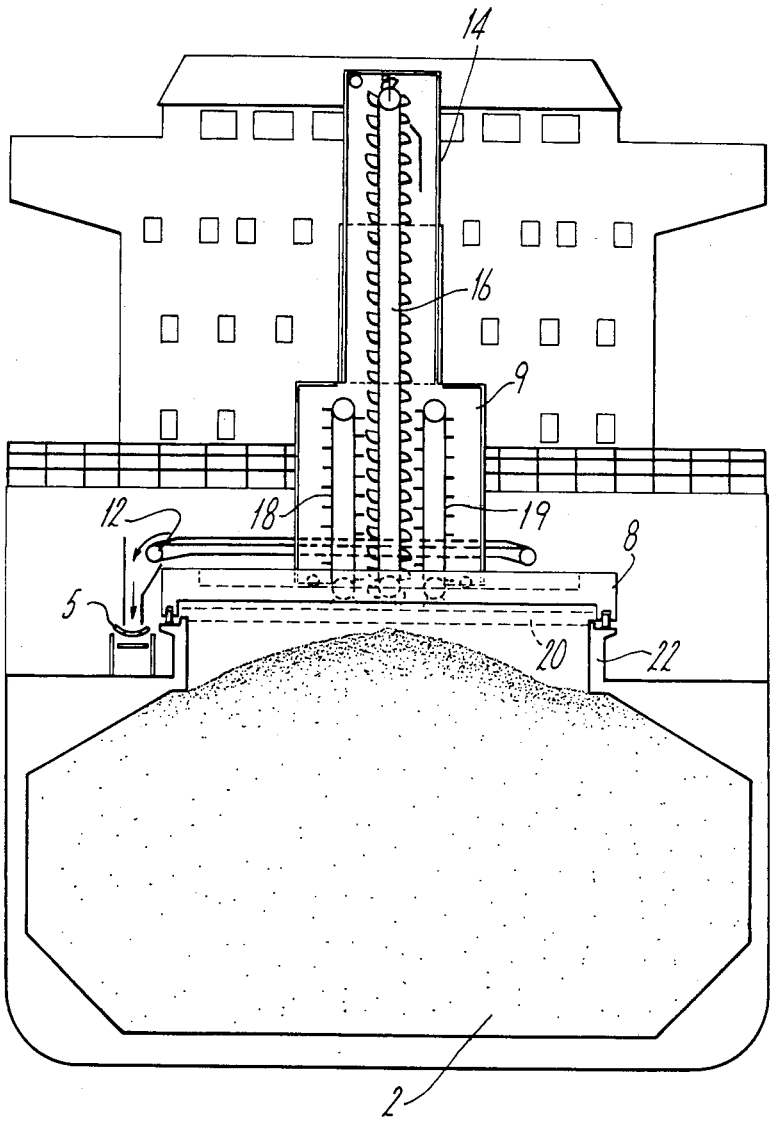

FIG. 7 shows a section like FIGS. 5 and 6, but with the cargo room full.

Figure 2:
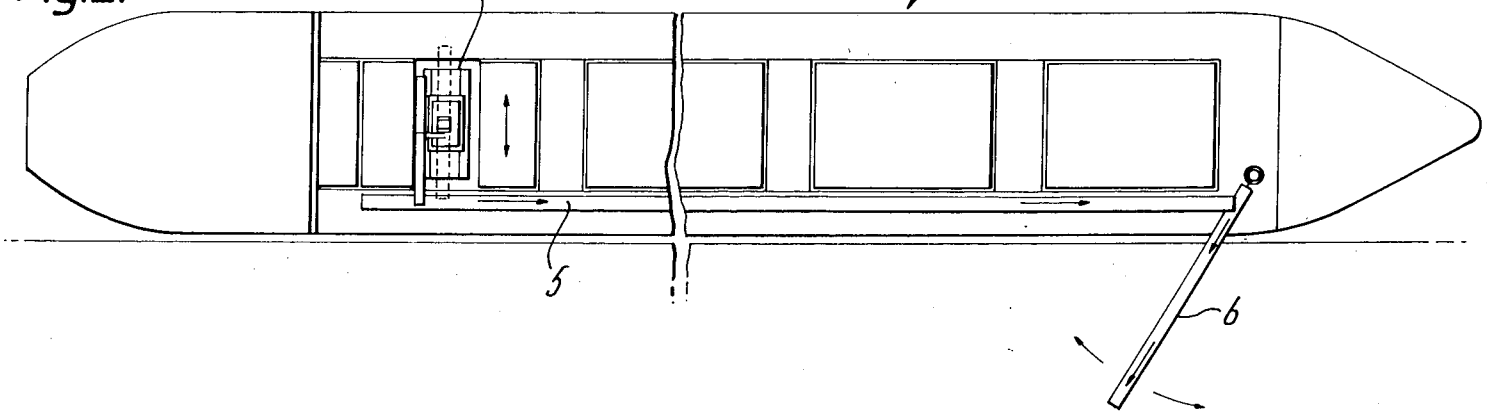
FIG. 2 shows the ship of FIG. 1 in plan view.

The ship shown in FIGS. 1 and 2, which generally is designated by 1, comprises a plurality of holds 2. The ship is provided with a trimming and emptying apparatus 3 according to the invention, for brevity called unloading apparatus, which is at work in the aft hold 2 of the ship. The unloading apparatus is in FIG. 1 shown in tow alternative positions, one 3' during unloading of one of the other holds, and the other 3" in parked position close to the superstructure of the ship. It will be understood that the unloading apparatus is movable along rails 4 extending in the longitudinal direction of the ship. Furthermore, the ship is provided with a longitudinal belt conveyor 5 which is fed by the unloading apparatus 3, and which in turn feeds a pivotably supported belt conveyor 6 for landing the bulk material 7.

Figure 3:
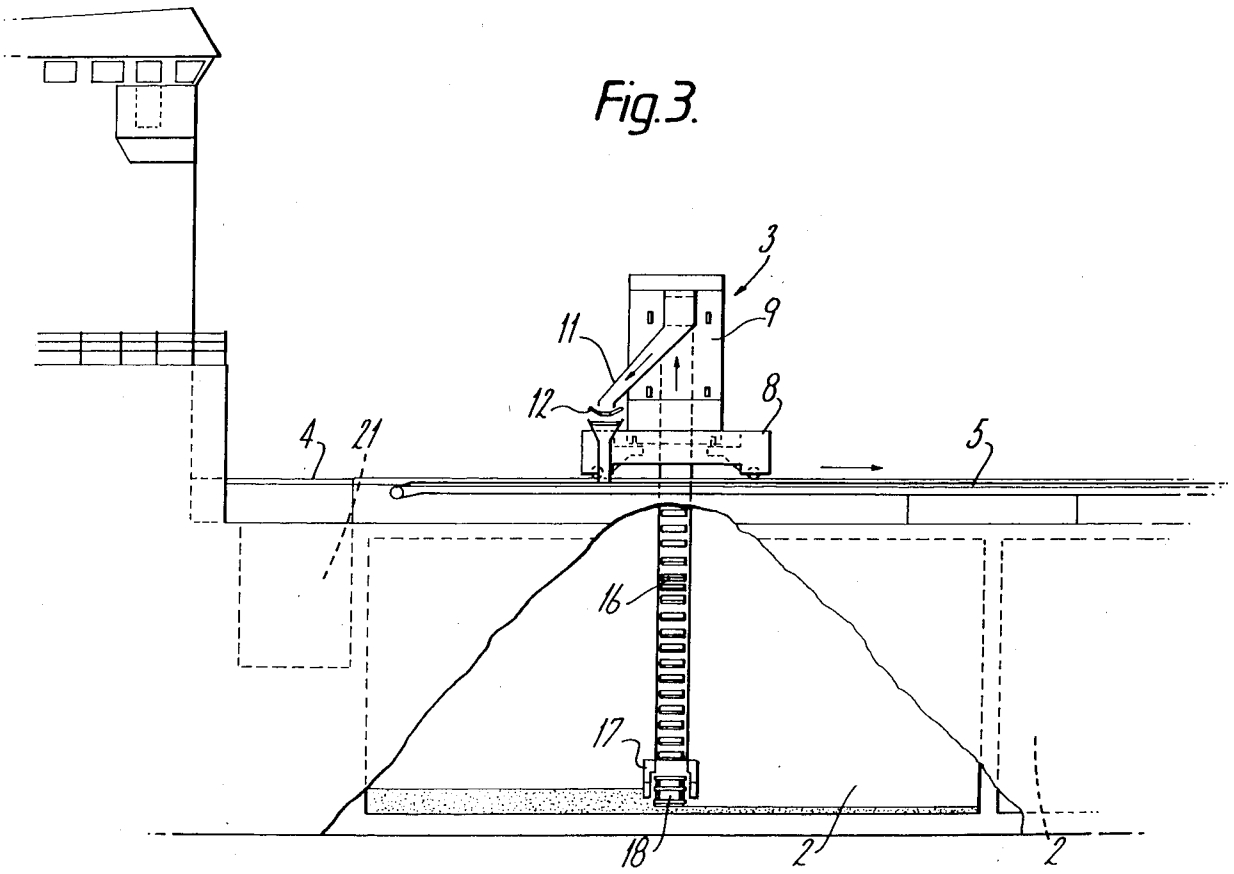
FIG. 3 shows a part of FIG. 1 at a larger scale.
Figure 4:
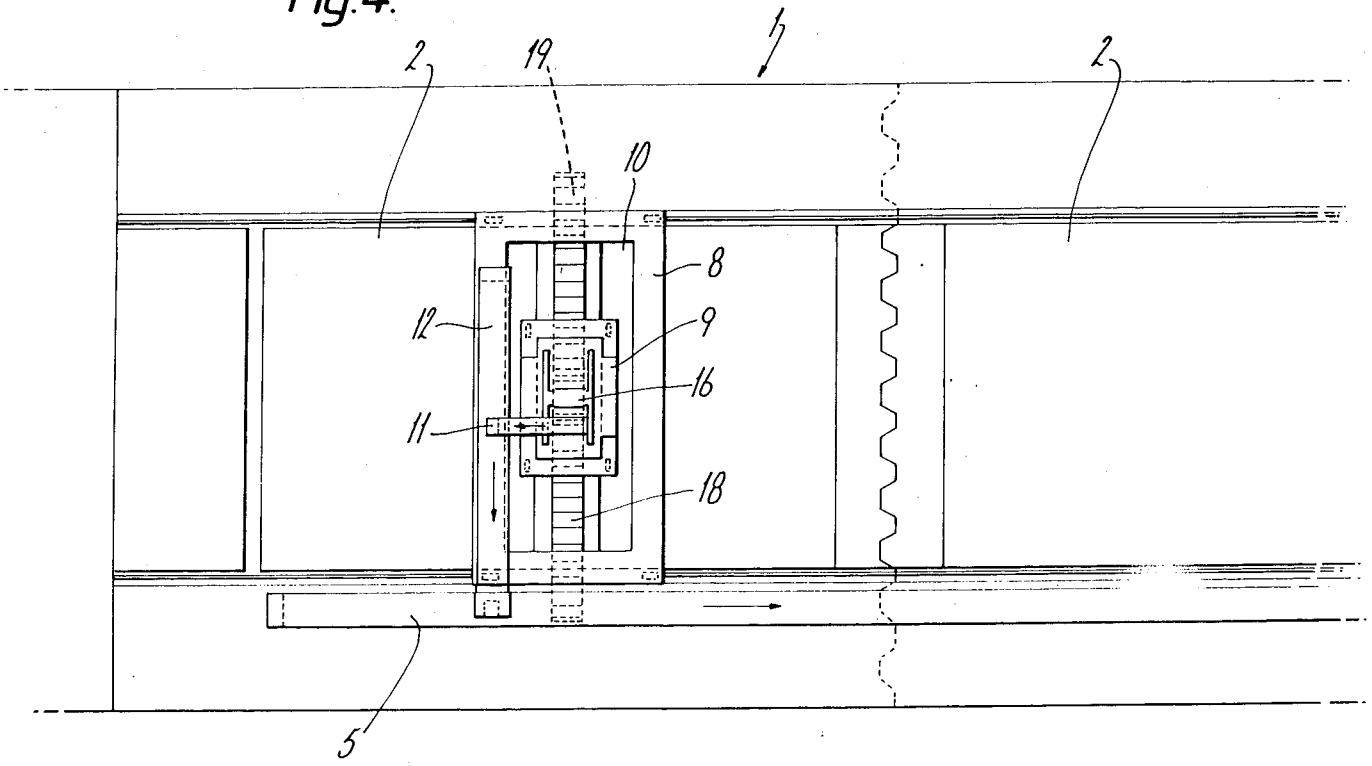
FIG. 4 shows a part of FIG. 2 at a larger scale.

From FIGS. 3 and 4, which are parts of FIGS. 1 and 2 at a larger scale, it will be evident that the unloading apparatus according to the invention comprises a chassis 8 which is drivable on rails 4. On the chassis a housing 9 is arranged which is movable over an opening 10 in the chassis in the transverse direction of the ship. From the housing 9 a chute 11 extends to a transverse belt conveyor 12 mounted on the chassis 8. The transverse belt conveyor feeds the longitudinal belt conveyor 5.

FIGS. 5–7 show further details of the unloading apparatus according to the invention. It will be seen that the housing 9 is provided with supports 13 for a telescoping extension 14 of the housing. This extension 14 is internally provided with a hoisting means 15 for a lifting means for bulk material in the form of a bucket elevator. The housing is of course provided with guides (not shown) for the lifting means.

At the bottom the lifting means 16 is provided with a fork suspension 17 for two opposite rake means 18, 19. These rakes are attached to the fork suspension by one of their ends so that by means of suitable means (not shown) they can be pivoted between a generally vertical and a generally horizontal position, as suggested in FIG. 6. The rakes work towards each other as shown by the arrows on their bottom side, so that the reaction forces exerted on the fork suspension 17 are largely cancelled. FIG. 6 also shows the motion direction and possibilities for the various components comprised in the unloading apparatus according to the invention. It is also suggested that the lifting means 16 with the rakes 18, 19 may be pivoted about a vertical axis. It is understood that this pivotability, along with the movability of the housing 9 in the transverse direction and the movability of the chassis 8 in the longitudinal direction of the ship (transversely of the drawing plane) make it possible for the rakes to reach the corners and other less accessible places in order to completely empty the hold.

FIG. 7 shows the lifting means 16 with the rakes 18, 19 in the upper position. In this condition the apparatus according to the invention may be driven from one hold to another without beng hindered by the hatches 20. This condition also forms the starting portion of the unloading. With the rakes in the upright position these are lowered together with the lifting means 16 down into the bulk material while they are driven in the usual way. The equipment is pressed down into the bulk material by means of its own weight, which, if necessary, may be inceased by providing the lifting means 16 and/or the rakes 18, 19 with ballast tanks which may be filled with water. When the free ends of the rakes clear the bottom side of the chassis 8, they may gradually be swung out to their most suitable position. It will be understood that the rakes may be swung independently of each other and thereby form different angles with the horizontal if this should be expedient. When the rakes have reached such a position that they can work fully, the chassis 8 and the housing 9 are driven in a pre-programmed pattern, so that the material is taken from both sides while the main movement proceeds in the longitudinal direction of the ship. The unloading is adjusted to the natural sliding angle of the material in order to use the least possible energy.

Figure 8:
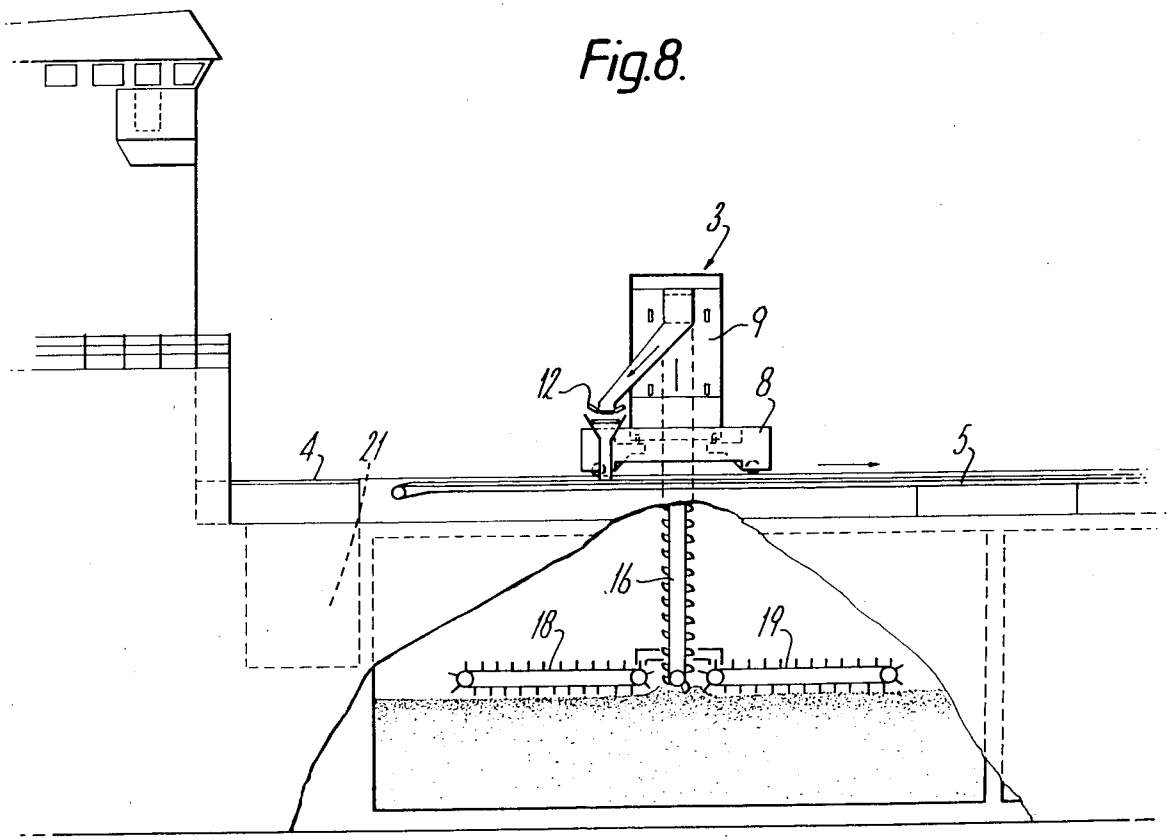

FIG. 8 show the unloading apparatus in an alternative position, the lifting means 16 with the rakes 18, 19 being pivoted 90° for the rakes to work in the longitudinal direction of the ship. This working position may be advantageous when the hatch coaming is relatively small with respect to the surface area of the hold. The pivotability of the rakes about a vertical axis is also of importance when they are used to trim the cargo in the hold. For this purpose the rakes are driven in the opposite direction so that they push the bulk material away from the middle of the hold towards it sides.

As shown in FIG. 3, the ship is provided with a recess 21 between the superstructure and the rear cargo room. This recess is used for parking the unloading apparatus as indicated by 3" in FIG. 1. By lowering the lifting means 16 with the rakes 18, 19 into the recess, the housing extension 14 will come low enough in order not to block the view from the bridge. Furthermore, in this position the unloading apparatus will be relatively well protected and may be sufficiently supported.

It will be seen that the rails 4 for the chassis 8 are arranged on the outside of the hatch coamings 22. Thus, the unloading apparatus may be driven from parking position to any of the holds without the necessity of removing any of the hatches 20 passed on the way. It will also be understood that the ship can be provided with more than one unloading apparatus according to the invention if this should be expedient for reasons of unloading capacity. However, it is not necessary to store the unloading apparatus on board the ship when it is not in use. Instead it can be taken off the ship when unloading is finished for use with other ships.

It will be understood that the invention may be modified and varied in a number of ways within the scope of the following claims. Thus, the apparatus may be provided with more than two rakes, e.g. four rakes working in two orthogonal directions. The lifting means, being a bucket elevator in the example shown, may be replaced by any suitable lifting means, e.g. a screw conveyor, a suction device, a bucket wheel or the like, according to the properties of the material. If the hold is deep or it is desirable to make the housing for the lifting means lower, the lifting means may be divided into parts being vertically movable with respect to each other, the lower part delivering to the upper. With such a solution one can avoid having to use a telescopting extension of the housing. The pivotability of the rakes about a vertical axis, which in the example shown in performed together with the lifting means, may alternatively take place independently of the pivoting of the lifting means.

From the preceding description it will be clear that according to the invention a trimming and emptying apparatus for bulk material has been provided having very high flexibility and a number of advantages. Thus, the apparatus may be installed in a very short time both in new and in existing ships without substantial modifications. The apparatus will be able to empty the holds almost completely so that use of other tools or machines becomes unnecessary during the final phases of the unloading. The apparatus can therefore work continuously and thereby save valuable unloading time. If the apparatus should be damaged when in use, it can be repaired on deck while the unloading may proceed with other means, for instance a grab. Furthermore, the unloading apparatus does not provent the ship from carrying cargos other than bulk material.

What I claim is:

1. Apparatus for trimming and emptying bulk material to and from substantially the complete volume in a storage room of a ship having length, width and height dimensions, said storage room having a hatch at the top thereof, comprising:

a chassis, means for moving said chassis relative to the length and width dimensions of said storage room, means having upper and lower ends, mounted on said chassis and movable therewith, for lifting the bulk material vertically out of said storage room when emptying said bulk material from said storage room, a pair of elongated rake means mounted at the lower end of said lifting means, each of said rake means comprising a plurality of transverse elongate blades attached to a flexiable endless loop member substanitally exposed to said bulk material on at least a lower side length of the rake means, for moving material along the length thereof to said lifting means when emptying said bulk material from said room, or along the length thereof away from said lifting means when trimming said bulk material, means for rotating said pair of rake means relative to said vertical dimensions of said room, and means for pivoting said pair of rake means for a substantially horizonal orientation in a vertical direction, and means for raising and lowering said lifting means and the rake means attached thereto, whereby said pair of rake means has at least five degrees of motion relative to the volume of said storage room to remove substantially the entire contents thereof.

* * * * *